US006588153B1

(12) United States Patent
Kowalczyk

(10) Patent No.: US 6,588,153 B1
(45) Date of Patent: Jul. 8, 2003

(54) POWER DOOR KIT

(75) Inventor: Thomas M. Kowalczyk, Farmington, CT (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/635,401

(22) Filed: Aug. 10, 2000

Related U.S. Application Data

(60) Provisional application No. 60/148,100, filed on Aug. 10, 1999.

(51) Int. Cl.[7] ..... E06B 1/00

(52) U.S. Cl. ..... 49/380; 49/280; 49/334; 49/340

(58) Field of Search ..... 49/29, 30, 139, 49/140, 340, 334, 335, 333, 280, 380

(56) References Cited

U.S. PATENT DOCUMENTS

| | | | | |
|---|---|---|---|---|
| 2,639,142 A | | 5/1953 | Morgan et al. | |
| 3,829,138 A | | 8/1974 | Morita | |
| 3,874,117 A | | 4/1975 | Boehm | |
| 3,886,425 A | | 5/1975 | Weiss | |
| 4,322,913 A | | 4/1982 | Himmer | |
| 4,330,958 A | * | 5/1982 | Richmond | 49/280 |
| 4,348,835 A | | 9/1982 | Jones et al. | |
| 4,438,962 A | | 3/1984 | Soloviff et al. | |
| 4,509,347 A | | 4/1985 | Young | |
| 4,541,202 A | | 9/1985 | Dockery | |
| 4,561,116 A | | 12/1985 | Neyret | |
| 4,713,910 A | | 12/1987 | Quante | |
| 4,750,118 A | | 6/1988 | Heitschel et al. | |
| 4,771,218 A | * | 9/1988 | McGee | 318/16 |
| 4,893,435 A | | 1/1990 | Shalit | |
| 4,902,052 A | | 2/1990 | Laine | |
| 4,907,429 A | | 3/1990 | Davis et al. | |
| 4,972,629 A | | 11/1990 | Merendino et al. | |
| 5,009,456 A | | 4/1991 | Eck | |
| 5,018,304 A | * | 5/1991 | Longoria | 49/340 |
| 5,040,331 A | * | 8/1991 | Merendino et al. | 49/25 |
| 5,040,391 A | | 8/1991 | Lin | |
| 5,375,374 A | | 12/1994 | Rohroff, Sr. | |
| 5,422,552 A | * | 6/1995 | Parisi | 318/466 |
| 5,428,278 A | * | 6/1995 | Bollengier et al. | 318/446 |
| 5,490,698 A | | 2/1996 | Dezso | |
| 5,507,120 A | * | 4/1996 | Current | 49/340 |
| 5,515,649 A | * | 5/1996 | Strab | 49/280 |
| 5,531,086 A | | 7/1996 | Bryant | |
| 5,613,324 A | | 3/1997 | Theune | |
| 5,634,298 A | | 6/1997 | Slopack | |
| 5,636,536 A | | 6/1997 | Kinnucan | |
| 5,673,948 A | | 10/1997 | Karpisek | |
| 5,678,436 A | | 10/1997 | Alexander | |
| 5,790,034 A | | 8/1998 | Khoury | |
| 5,791,179 A | | 8/1998 | Brask | |
| 5,878,530 A | | 3/1999 | Eccleston et al. | |
| 5,910,075 A | * | 6/1999 | Arnell et al. | 49/25 |
| 5,911,460 A | | 6/1999 | Hawkins et al. | |
| 5,987,818 A | * | 11/1999 | Dabideen | 49/280 |
| 6,049,287 A | * | 4/2000 | Yulkowski | 340/693.12 |

FOREIGN PATENT DOCUMENTS

| | | |
|---|---|---|
| DE | 298 01 134 U 1 | 4/1998 |
| DE | 197 26 021 A 1 | 12/1998 |
| EP | 0 499 884 A1 | 5/1992 |

* cited by examiner

*Primary Examiner*—Jerry Redman
(74) *Attorney, Agent, or Firm*—Pillsbury Winthrop LLP

(57) ABSTRACT

The present application discloses a door kit for installation across an opening formed through the wall of a building. The door kit has a power-operated door latch and a power-operator door operator.

28 Claims, 8 Drawing Sheets

POWER DOOR KIT

The present application claims priority to U.S. Provisional Application of Kowalczyk, Ser. No. 60/148,100, filed Aug. 10, 1999, the entirety of which is hereby incorporated into the present application by reference.

FIELD OF THE INVENTION

The present invention relates to a door kit for installation across an opening formed through a wall of a building. More specifically, the present invention relates to a door kit that includes a power-operated door latch and a power-operated door operator.

BACKGROUND OF THE INVENTION

Conventional door panels in residential buildings usually carry a mechanical lock that has an extendible and retractable bolt. To lock the door panel against unauthorized entry, the resident operates the lock to extend the bolt into a corresponding opening on the door jamb. To regain entry to the building through the doorway from the exterior thereof, a matched key is inserted into the lock and then turned to retract the bolt into the door panel. This allows the door panel to be swung freely under manual power to its open position. This type of system can be problematic for persons carrying awkward loads, such as grocery bags, because the process of finding the matched key, inserting it into the lock, and then turning it to retract the bolt usually requires the person to place their load on the ground. Also, properly aligning the key with the corresponding opening on the lock can be difficult for those with limited or impaired manual dexterity, such as the elderly or those suffering from certain physical disabilities.

To overcome the problems associated with conventional key-type locks, there have been provided manually operated remote controlled openers that use a portable IR or RF transmitter to actuate a power-operated door latching system. The advantage of such a system is that the door can be unlatched simply by pushing a button on the transmitter within a specified range of the latching system's receiver. This can bc done fairly easily while carrying a load or by persons with limited or impaired dexterity. An example of such a system is disclosed in U.S. Pat. No. 4,972,629.

As an alternative to using a manually operated remote controlled opener, U.S. Pat. No. 5,541,585 discloses the use of a portable transceiver carried by the person seeking entry and a fixed transceiver mounted on or adjacent the door frame. The fixed transceiver emits an interrogation signal over a limited area near the door panel that causes the portable transceiver to responsively emit a response signal back to the transceiver when in the aforementioned limited area. In response to receiving the response signal, the fixed transceiver then signals the door latch to unlatch the door panel. The advantage of this system is that there is no need for the person desiring entry to take an active role in the unlatching operation beyond simply carrying the portable transceiver into the limited area defined by the emissions of the fixed transceiver. The portable transceiver can be easily carried in the person's pocket or handbag.

While both the manually operable remote transmitter-type system disclosed in the aforementioned '629 patent and the transceiver-type system disclosed in the aforementioned '585 patent make it easier for persons with difficulty operating conventional key-actuated locks (either as a result of having their hands occupied carrying a load or due to some form of physical impairment) to gain access into their residence, they do not provide any assistance in actually moving the door panel from the closed position thereof to the open position thereof after unlatching. For persons with physical disabilities, this can present another obstacle to easy passage into their residence.

A number of patent references, such as U.S. Pat. No. 5,878,530, the entirety of which is hereby incorporated into the present application by reference, have disclosed the idea of retrofitting kits that provide a door operator, a door unlatching mechanism, and a remotely controlled actuating system for operating the operator and the unlatching mechanism. These retrofitting kits allow a person to approach the residential structure and initiate a door opening sequence by actuating a remote transmitter to signal the actuating system to unlatch the unlatching mechanism and cause the door operator to thereafter pivot the door panel under power. Thus, unlatching and opening of the door can be performed simply by depressing a button on the remote transmitter. The components of these retrofitting kits, however, are designed to be mounted on or adjacent to pre-existing door panels with most of the components thereof exposed. These retrofitting kits are not designed for efficient installation during initial construction of the residential structure. That is, installing a retrofitting kit on an exterior door assembly while constructing the residence complicates door construction for the contractor.

Consequently, there exists a need for an improved and door system that provides for powered unlatching and opening of the door panel and overcomes the shortcomings of the prior art systems discussed above.

SUMMARY OF THE INVENTION

To meet the need described above, the present invention provides a door kit for installation across an opening through which limited access is to be permitted formed through a wall of a building. Preferably, the door kit is sold preassembled for ease of installation. The type of building with which the door kit of the present invention is preferably used is a residential structure, such as a freestanding home, a condominium or an apartment. In addition, the term residential structure may be construed to include structures that are somewhat commercial in nature, but provide living quarters for people. For example, hotel or hospital rooms may be considered residential structures within the scope of the present invention, although hotels and hospitals are usually treated of being commercial in nature for zoning purposes and other regulatory matters. The present invention also contemplate that the door kit of the present invention could also be used in other settings. For example, the door kit could be used to provide limited access to a storeroom in a retail store, to an office in work environment, or to a secure area in an industrial setting. Additionally, the door kit could be used in the entryway of retail stores or restaurants.

The door kit comprises a frame constructed and arranged to be mounted along a peripheral edge of the aforesaid wall opening. The frame provides a doorway through which persons can travel. Usually, the frame will have a pair of vertically extending side jambs and an upper rail extending perpendicularly between the upper ends of the side jambs. However, the frame may take on other shapes and configurations. A door sill assembly with a thermal break may optionally be provided between the lower ends of the vertical side jambs for door kits that are going to be exposed to the weather.

A door panel that mounts to the frame for movement between (a) an open position wherein the door panel is moved away from the doorway to permit persons to travel therethrough and (b) a closed position wherein the door panel is moved into covering relation with respect to the doorway to prevent persons from travelling therethrough. The door panel may be a pivotally mounted door panel that swings between its opened and closed positions, such as a regular swing door or a balanced swing door, or it may be a sliding door panel that moves rectilinearly guided on tracks between its opened and closed positions. Also, the door kit may include a plurality of sliding or pivoting door panels instead of just a single door panel or the door panel may be a bi-fold door panel.

A power-operated door latch is carried by one of the door panel and the frame. The door latch is operable under power to selectively move between (a) a latched position wherein, when the door panel is in the closed position thereof, the door latch engages structure on the other of the door panel and the frame to releasably maintain the door panel in the closed position thereof, and (b) an unlatched position wherein the door latch is released to allow the door panel to move from the closed position thereof to the open position thereof. Preferably, the latch is carried by the frame because it is more difficult to supply power to components carried by a movable door panel. However, providing the door latch on the door panel is within the scope of the present invention. The kit also comprises a power-operated door operator that is operable under power to selectively move the door panel between the open and closed positions thereof. The power used to operate the operator and the latch is preferably electricity supplied from the residential structure's electrical power supply. However, the present invention also contemplates supplying electricity to these components via a battery. Also, power may be supplied using hydraulic fluids or pneumatics.

A controlling system is communicated to the door latch and the door operator and has an input device that receives input signals. The input device may comprise a fixed receiver and remote transmitter, a card reader and coded card, a fixed and portable transceiver, a manual keypad, or any other suitable arrangement. The controlling system is adapted to cause the door operator to move the door panel between the open and closed positions thereof responsive to the input device receiving input signal. The controlling system is also adapted to operate the door latch so as to cause the door latch to move from the unlatched position thereof to the latched position thereof responsive to the input device receiving an input signal. The controlling system is adapted such that, at least when the door panel is in the closed position thereof with the door latch in the latched position thereof and an input signal is supplied to the input device, the controlling system determines whether the unlatching input signal is a valid access signal and then causes the door latch to move from the latched position thereof to the unlatched position thereof only if the input signal is determined to be a valid access signal. This prevents unauthorized passage through the doorway.

Incorporating each of these elements into a kit allows the entire system to be easily and quickly installed.

Other objects, features, and advantages of the present invention will become apparent from the following detailed description, the accompanying drawings, and the appended claims.

DETAILED DESCRIPTION OF THE PREFERRED EMBODIMENT OF THE INVENTION

Figure 1:
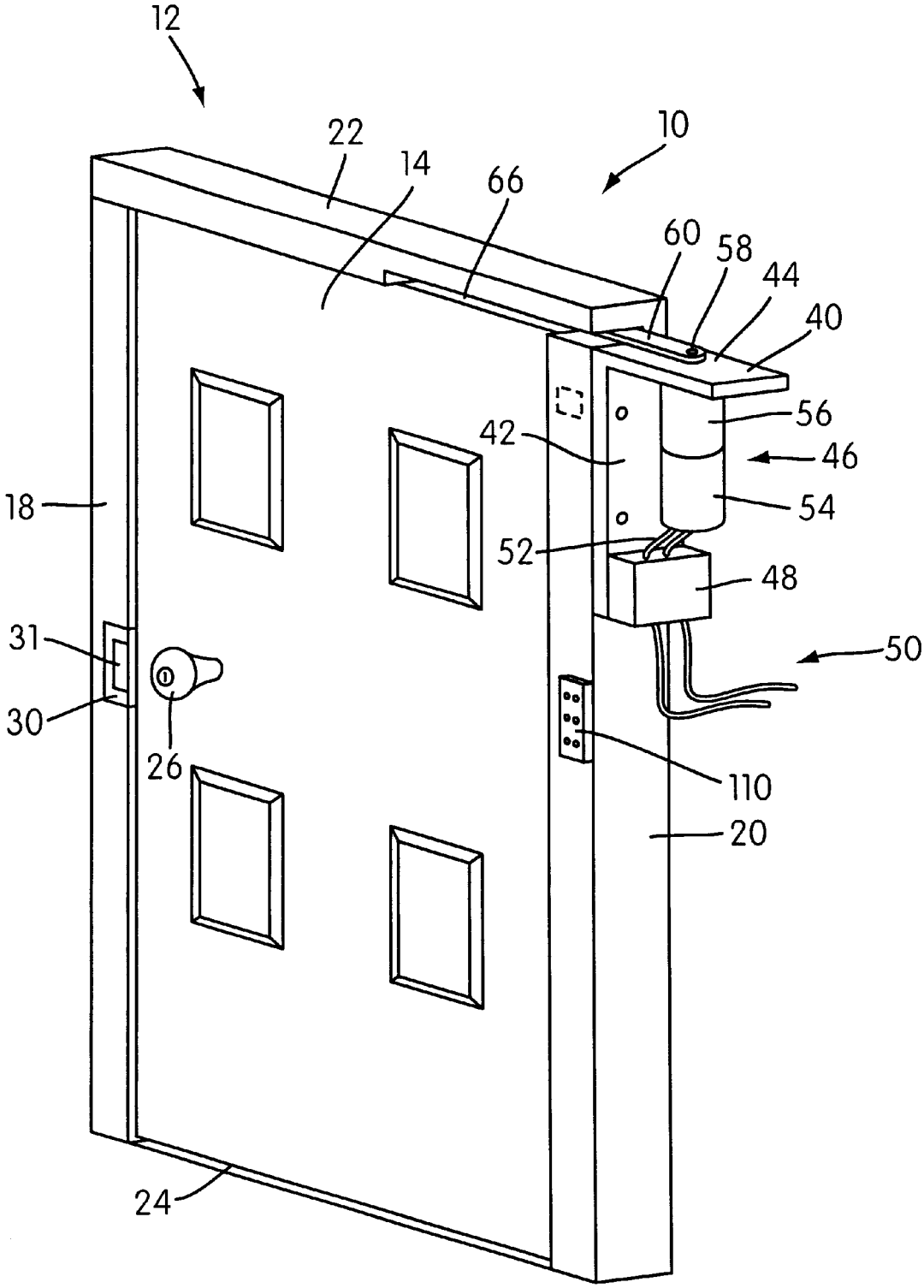
FIG. 1 is a perspective view of a door kit for installation across an opening formed through the exterior wall of a residential structure constructed in accordance with the principles of the present invention.
Figure 2:
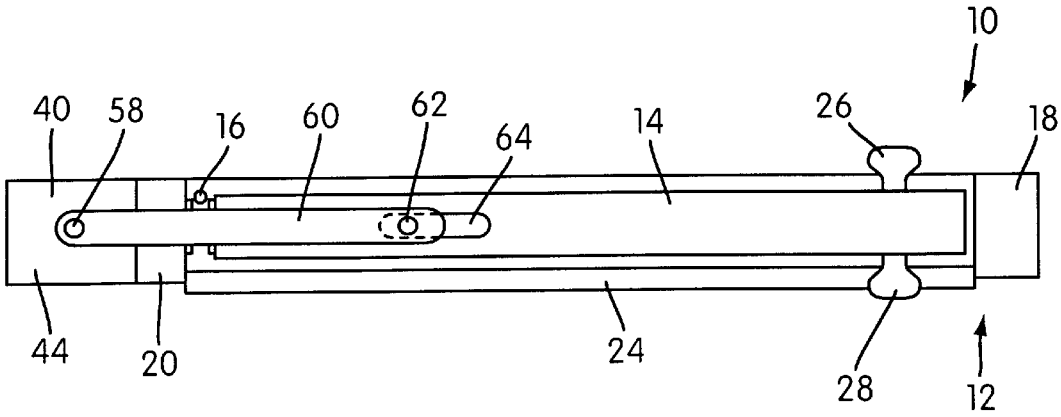
FIG. 2 is a top view of the door kit of FIG. 1 with the upper frame member thereof removed to facilitate viewing of the door panel and the door panel in the closed position thereof.
Figure 3:
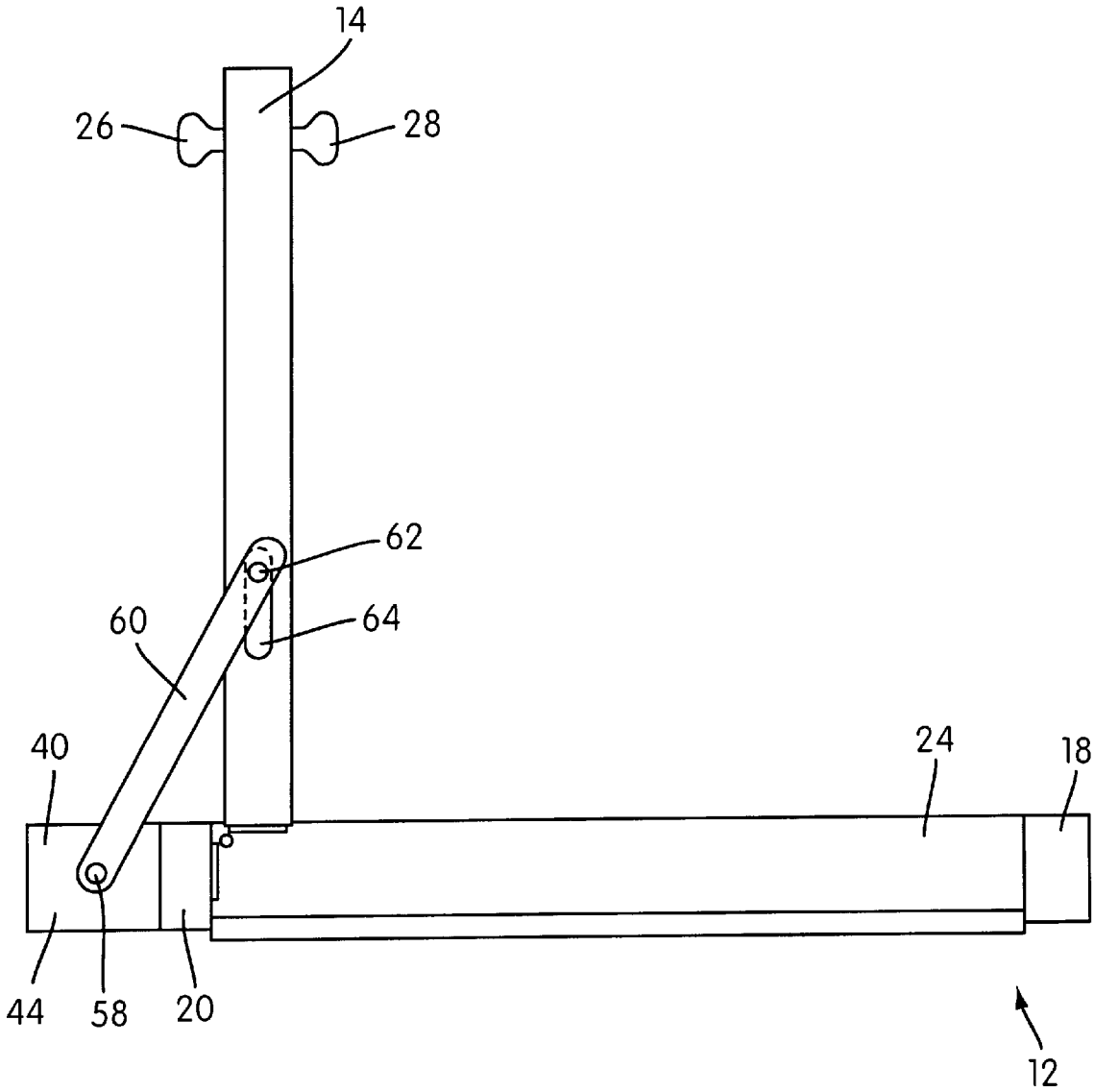
FIG. 3 is a top view similar to FIG. 2 with the door panel pivoted 90 degrees open.

FIG. 1 shows a pre-assembled door kit, generally indicated at 10, constructed in accordance with the principles of the present invention. The kit comprises a peripheral frame, generally indicated at 12, and a door panel 14 pivotally mounted to the frame 12 for pivotal movement about a generally vertical pivot axis by a plurality of hinges 16 (FIGS. 2 and 3). The view shown in FIG. 1 is taken from the interior side thereof.

The frame 14 comprises a pair of generally parallel and generally vertically extending side stiles 18, 20. An upper frame rail 22 is coupled to and extends transversely across the upper ends of the stiles 18, 20 generally perpendicularly thereto. The exposed surfaces of the side stiles 18, 20 and the upper rail 22 may bc molded or otherwise contoured to enhance the overall aesthetic appearance of the door kit 10.

A door sill assembly 24 is coupled to and extends transversely between the lower ends of the stiles 18, 20 generally perpendicularly thereto. The door sill assembly 24 may be of any construction and is preferably of the type that has a subsill that drains water away towards the exterior of the residential structure into which the door kit 10 is installed and a metal tread with a non-metallic thermal break for reducing or preventing heat loss through the metal material of the tread. Weather stripping may be provided along the perimeter of the door panel 14 to prevent the ingress of moisture and the loss of heat between the door panel 14 and the door sill assembly 24. It should be understood, however, that the door sill assembly 24 may be omitted if the door kit is to be of the type that is not exposed to the weather and other outdoors conditions. For example, the door kit 10 may be designed for installation in an apartment whose exterior faces an enclosed building hallway and thus does not see rain or other such weather conditions.

Although the frame 12 shown has a generally rectangular shape and is designed for use with a hinged door panel 14, any type of frame may be used in practicing the principles of the present invention. For example, the frame may have an arched upper frame rail instead of a straight one for aesthetic purposes. Also, the present invention contemplates applying the principles thereof to sliding door assemblies that have one or more sliding panels that move rectilinearly in a rolling or sliding action along tracks in the frame. Thus, the frame may also be a sliding door frame.

The door panel 14 is generally rectangular may be of any hollow or solid construction, such as wood, rigid thermoplastics, or metal. The hinges 16 are of typical construction with one flange thereof attached to a vertical side edge of the door panel 14 and the other flange thereof attached to stile 20. A knob 26, 28 is carried on each face of the panel 24 adjacent the free edge thereof. The knobs 26, 28 function together as conventional knobs and each may be rotated to retract a conventional latch member (not shown) inwardly into the door panel 24. The exterior knob 28 has a conventional tumbler lock that functions to prevent the latch member from being retracted into the door panel unless a matched key is inserted into the tumbler and turned in an appropriate unlocking direction. The interior door knob 26 has a manually engageable lock and release member that can be turned between locking and unlocking positions to extend and retract the latch member, respectively, from the building interior without the need for using the matched key. As will become appreciated later in the application, the provision of this conventional knob and lock arrangement is to allow for opening of the door panel 14 in the event that the power-operated systems that are discussed later in the application are no longer capable of functioning, particularly the power-operated door latch 30 responsible for releasing the door panel 14 for its opening movements. Such events may include power outages or unexpected failure of particular components.

As an alternative to using the conventional knob and lock arrangement, a battery back-up system (not shown) may be provided in the door kit 10 to allow for operation of the power-operated systems in the event of an electricity outage. The battery back-up system would store sufficient energy for a number of door latching/unlatching and opening/closing operations while the electrical power supply for the residential structure is out (or during any other conditions wherein the supply of electric power to the power operated systems of the door kit 10 is interrupted). It is to be understood, however, that the principles of the present invention may be practiced with both the conventional knob and lock arrangement and the battery back-up system, the battery back-up system alone, the conventional knob and lock arrangement, or neither of these two back-ups.

A power-operated door latch 30 is carried by the frame 12. Preferably, the door latch 30 mounted on side stile 18 at approximately the same height as the latch member of the door panel 14. When the door panel 14 is moved to the closed position thereof, the latch member extending therefrom extends into the power-operated door latch 30. The door latch 30 can be moved between two positions—a latched position and an unlatched position. When the door panel 14 is closed and the door latch 30 is in the latched position, the door latch 30 engages the door panel's latch member to maintain the door panel 14 in its closed position. When the door latch 30 is in the unlatched position thereof, the door latch 30 releases the door panel's latch member to allow the door panel 14 to be moved from the closed position thereof through its range of opened positions. Specifically, the latch 30 carries a pivoting latch and release member 31 that pivots out of the way of the door panel 14 as it swings towards its open position. When the door latch 30 is in the latched position thereof with the door panel 14 closed, a bolt is moved into an operative position to engage the member 31 and prevents pivotal movement thereof. As a result, the latch member on the door panel 14 engages the latch and release member 31 so that member 31 prevents the door panel from pivoting in its opening direction. When the door latch 30 is in the unlatched position thereof, the bolt is moved to an inoperative position to disengage from the latch and release member 31 and to thereby allow its pivotal movement toward the kit's interior side. As a result, the door panel 14 may be considered to be released for movement in its opening direction because the pivotable latch and release member 31 no longer prevents an obstruction to its inward opening movement. Either a solenoid or a motor may be used to move the door latch's bolt under electric power between its operative and inoperative positions.

The power-operated door latch 30 may also have the same frame-mounted construction as shown in U.S. Pat. No. 5,911,460, the entirety of which is hereby incorporated into the present application by reference. Although the door latch 30 is shown as being carried by the frame 12, it is within the scope of the present invention to provide the power-operated door latch on the door panel 14 instead. For example, reference may be made to the subject matter disclosed in U.S. Pat. No. 5,791,179, the entirety of which is hereby incorporated into the present application by reference, which discloses a power-operated door latch carried by the door panel. However, it is preferred to provide the latch on the frame 12 to obviate the need for running electrical wiring into the movable door panel 14.

An L-shaped mounting bracket 40 is secured by fasteners to side stile 20 opposite the door panel 14 and the hinges 16. The bracket 40 has a vertically extending planar member 42 and a horizontally extending planar member 44. A power-operated door operator 46 is fixedly mounted to the underside of the horizontal planar member 44 and a controller 48 is fixedly mounted to the vertical planar member 42 below the operator 48. As a result of this arrangement, the controller 48 and the operator 46 will be concealed within the wall. In the situation where the kit 10 is installed in the exterior wall of a residential structure, the controller 48 and operator 46 will be concealed between the interior and exterior surfaces of the wall of the residential structure when the door kit 10 is installed. This provides an enhanced aesthetic appearance.

Figure 5:
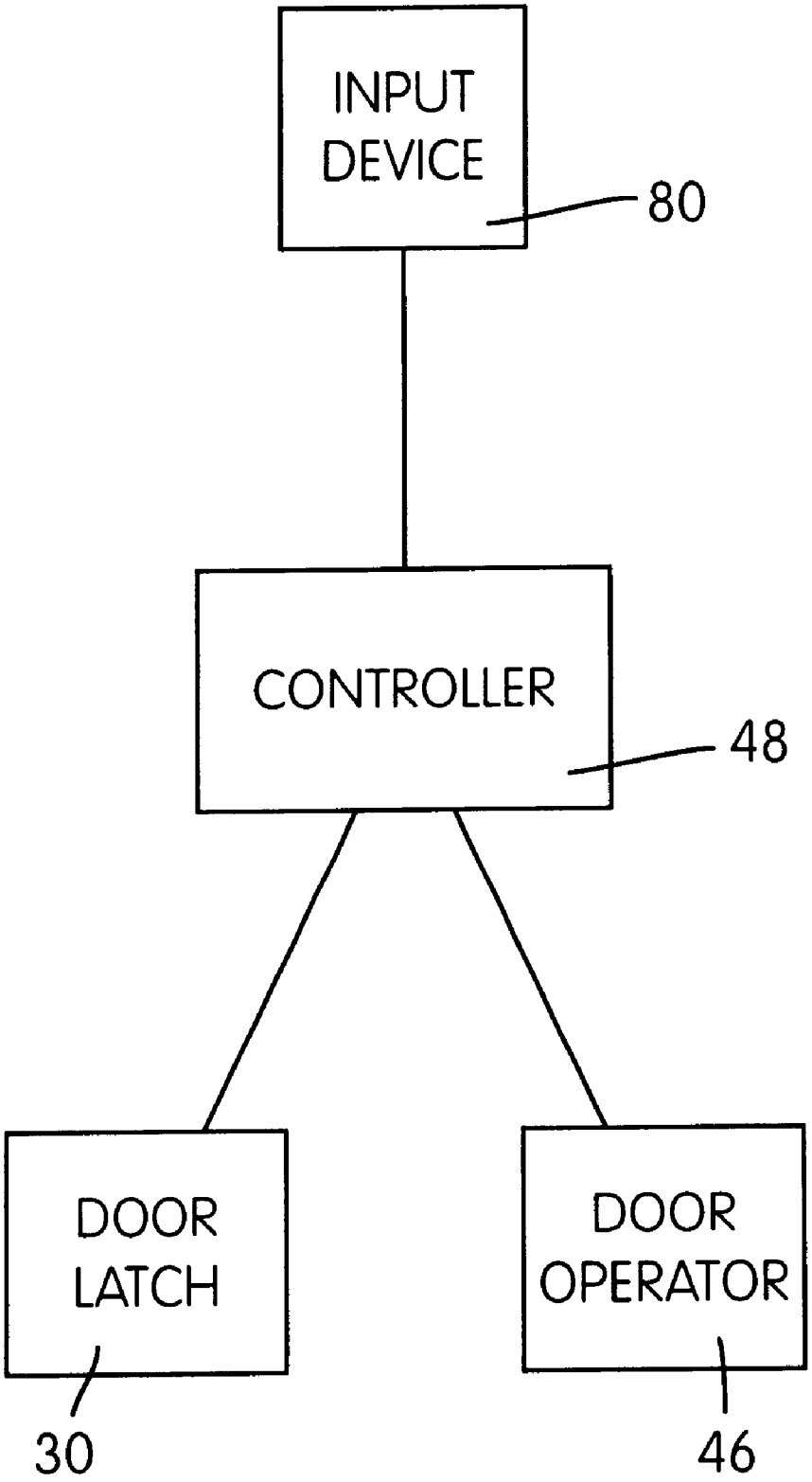
FIG. 5 is a block diagram schematically showing interconnection between various functional components of the door kit of the present invention.

The controller 48, which may be a chip-based microprocessor or hard-wired logic circuitry, has a pair of electrical wires, generally indicated at 50, extending therefrom. The free ends of these electrical wires 50 connect in power supplying relation to positive and negative terminals of the residential structure's electrical power supply. The controller 48 also has a second set of electrical wires, generally indicated at 52, extending therefrom that are connected to positive and negative terminals of the door operator 46. These wires 52 connect the operator in power supplying relation to the residential structure's electrical power supply via the controller 48. A third set of wires (not shown for clarity's sake) extend along the frame from the controller 48 and are connected to positive and negative terminals of the door latch 30. These wires connect the door latch 30 in power supplying relation to the residential structure's electrical power supply via the controller 48. The connections between the controller 48, the door latch 30 and the door operator 46 are shown schematically in the block diagram of FIG. 5.

The door operator 46 comprises a low power reversible electric motor 54 coupled to a speed reducing transmission 56. Preferably, the motor 54 is a reversible electric motor with a low power rating. The transmission 56 is preferably a planet gear transmission such as the one shown in currently pending U.S. Provisional Applications of Kowalcyzk, Ser. No. 60/118,791, Ser. No. 09/497,729 now U.S. Pat. No. 6,530,178, and Ser. No. 09/491,730 now U.S. Pat. No. 6,336,294 the entirety of each of which is hereby incorporated into the present application by reference, although any other suitable transmission may be used in its place. The planetary gear arrangement is preferred for the high amount of torque output and speed reduction that can be achieved in a relatively compact size. A rotatable output shaft 58 extends upwardly from the transmission 56 and a rotatable lever arm 60 is fixedly secured at one end thereof to the output shaft 58 for rotational therewith. The motor 54, the transmission 56, and the output shaft 58 all share a common axis (i.e., they are coaxial) that extends generally parallel to the pivot axis of the door panel 14.

When electricity is supplied to the motor 54, it rotates the output shaft 58 via its coupling through the transmission 56 to affect rotation of the lever arm 60. The direction in which the output shaft 58 and the arm 60 rotate is determined by the polarity of the electrical power that is being supplied to the motor 54 by the controller 48. That is, the controller 48 functions not only to supply power to the motor 54, it functions to control the direction in which the motor 54 rotates the arm 60 and the output shaft 58 by reversing polarity each time a reversal of rotation direction is desired. As will become appreciated later in the application, rotation of the arm 60 in one direction will be considered the door opening direction and rotation of the arm 60 in the opposite direction will be considered the door closing direction.

The controller 48 also preferably functions to regulate the amount of power supplied to the motor 54 depending upon on the position of the door panel 14. Specifically, it is contemplated that maximum power would be supplied to the motor 54 when the door panel 14 is fully closed and the operator 46 is starting to rotate the arm 60 in the door opening direction to overcome the door panel's inertia and the potential pressure differentials between the air inside the building structure and the air outside the building structure. Likewise, it is contemplated to supply maximum power to the motor 54 when the door panel 14 is moving in its closing direction and is almost to its fully closed position to ensure that the panel 14 is completely closed.

As can be best appreciated from FIGS. 2 and 3, the arm 60 has a roller 62 rotatably mounted on the end thereof opposite the output shaft 58 for rotation about a generally vertically extending axis. The door panel 14 has an elongated, recessed track 64 formed in the upper edge thereof. The roller 62 is received in the track 64 for rolling movements therein. As the arm 60 rotates in the door opening or closing direction thereof under power of the operator 46, the roller 62 cooperates with the track 64 to pivot the door panel 14 about the pivot axis thereof provided by the hinges 16. More specifically, as the arm 60 is being rotated, the roller 62 rolls inside the track 64 against the walls thereof to affect swinging or pivotal movement of the door panel 14. As can be appreciated from comparing FIGS. 2 and 3, the roller 62 is positioned adjacent one end of the track 64 when the door is fully closed and moves in a generally rectilinear manner towards the other end of the track 64 as the door panel 14 swings in its opening direction.

As can be appreciated from FIG. 1, an elongated recess 66 is formed in the underside of the upper rail 22. The recess 66 extends inwardly from the interior side of the rail 22 for approximately ⅔ of its width and from the end of the rail 22 adjacent the operator 46 for approximately ⅓ of its length. This recess 66 allows the arm 60 to extend underneath the rail 22 in generally parallel relation to both the door panel 14 and the rail 22 when the door panel 14 is in its fully closed position. As the arm 60 begins rotating in its door opening direction when the door panel 14 is in its fully closed position, the arm 60 will move outwardly from the recess 66 and out from beneath the rail 22. Conversely, as the arm rotates in its door closing direction, the arm 60 moves inwardly into the recess so as to be disposed underneath the rail 22.

Figure 4:
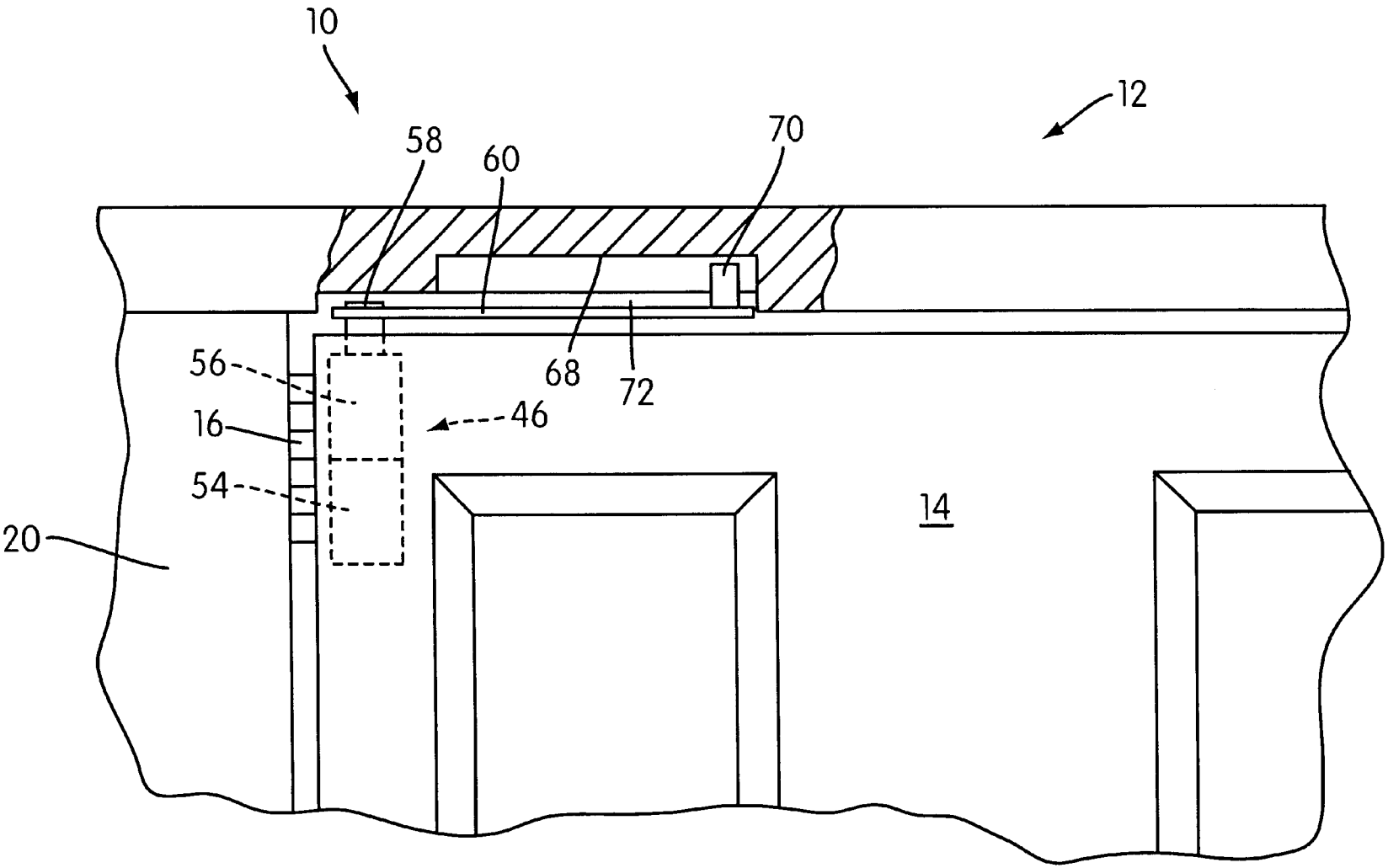
FIG. 4 is a partial sectional view of an alternative arrangement for the door kit of the present invention.

FIG. 4 shows an alternative arrangement wherein the door operator 46 is carried within a bore or other space formed inside the door panel 14. In the arrangement of FIG. 4, a track 68 similar to track 64 is formed on the underside of the rail 22 and a roller 70 similar to roller 62 is rotatably mounted on the end of the arm 60. The track 68 and the roller 70 function in a similar, cooperative manner as the track 64 and the roller 62 discussed above, albeit reversed. An elongated recess 72 similar to recess 66 is formed in the underside of the upper rail 22 to accommodate receipt of the arm 60.

The controller 48 also functions to control operation of the door latch 30. Specifically, the controller 48 supplies power to the door latch 30 to cause. the solenoid or motor thereof to move the latch 30 between the latched and unlatched positions thereof.

An input device 80 communicates to the controller 48. The input device 80 is adapted to receive input signals and together the controller 48 and the input device 80 comprise a controlling system.

The input device may be a fixed transceiver that transmits an interrogation signal to a portable transceiver carried by the resident as disclosed in U.S. Pat. No. 5,541,585, the entirety of which is hereby incorporated into the present application by reference for all purposes. A motion detector as disclosed in the '585 patent may be used to activate the fixed transceiver only when motion near the unit 10 is detected, thereby preventing the transceiver from continuously operating. Also, a numeric keypad may be used on the input device. Another alternative is to use a card reader into which an unauthorized entrant inserts a card carrying a magnetic strip.

Figure 6:
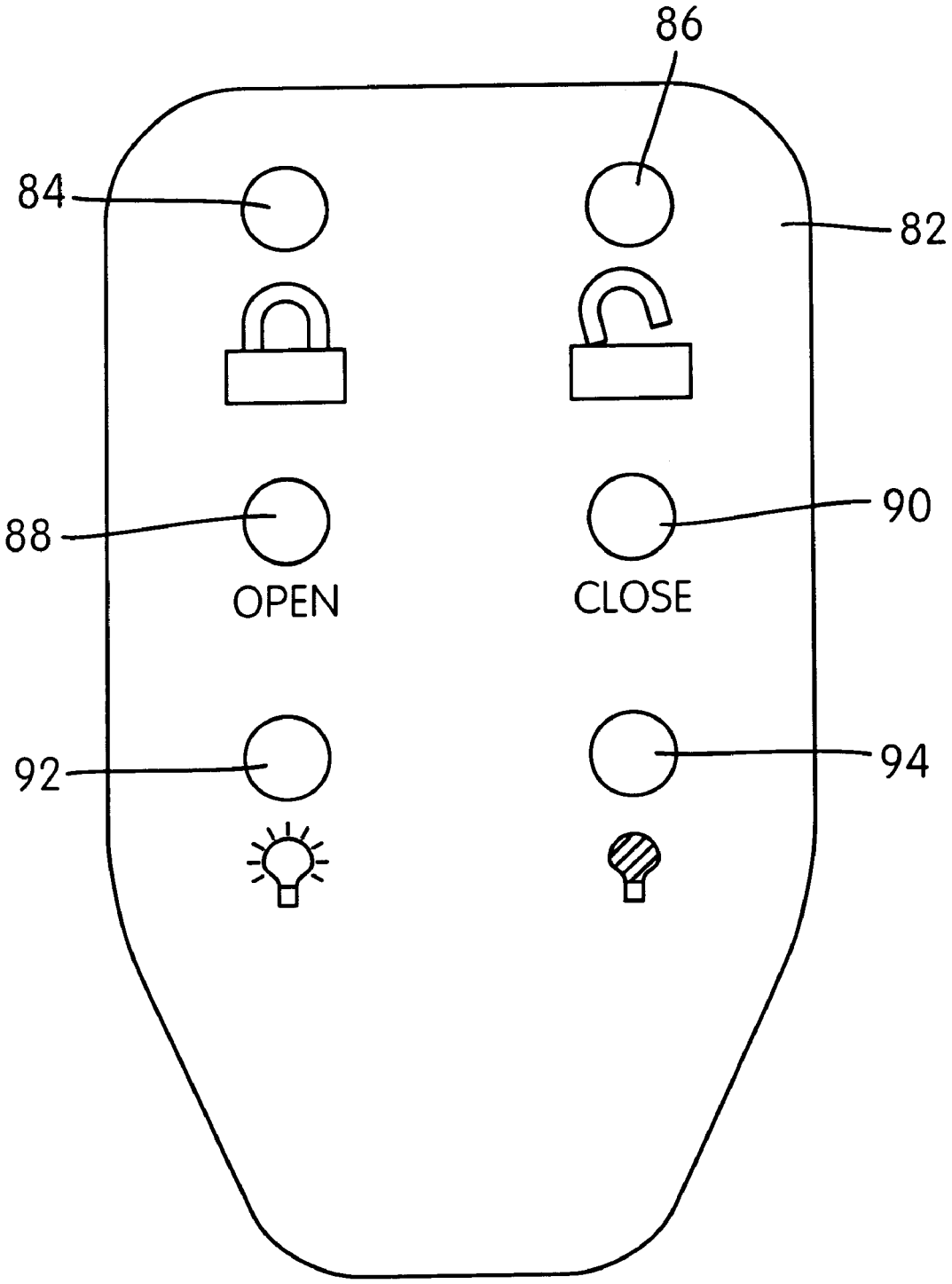
FIG. 6 is a top view of a RF or IR portable remote transmitter that may be used to send a valid access signal to the input device of the door kit.

The input device 80 may also take the form of a fixed IR or RF receiver that receives input signals from a portable IR or RF remote transmitter carried by the resident. FIG. 6 shows an example of such a transmitter 82. The illustrated transmitter 82 has a lock button 84, an unlock button 86, and door open button 88, a door close button 90, a light on button 92, and a light off button 96. Words or insignias are provided to denote the function of each button. The input signals transmitted by the remote transmitter 82 carry an access code that is detected by the receiver (i.e., the input device). The input device 80 determines whether an input signal transmitted thereto carries a valid access code. If the input device determines that the transmitter 80 does carry a valid access code, then, it transmits a corresponding signal to the controller 48 so that it can operate the door latch 30 and/or the door operator 46 in an appropriate manner. If the signal received by the input device 80 does not carry a valid access code, then the input device 80 transmits no signal to the controller 48. Thus, to power operate the door unit components from the residential structure exterior, a transmitter that emits input signals carrying or encoded with a valid access code is required. Alternatively, the input device 80 may simply function to receive input signals to the controller 48 and the controller 48 would make the determination as to whether the signal contains a valid access code. Thus, it can be broadly stated that the controlling system determines whether the input signal has a valid access code.

When a manual keypad is used, the keypad or controller makes the determination as to whether a valid access code has been entered by determining whether a person attempting to enter has punched in the proper, predetermined numeric code. Determination of a valid access code for the portable/fixed transceiver system may be performed as taught in the above-incorporated '585 patent.

Figure 7:
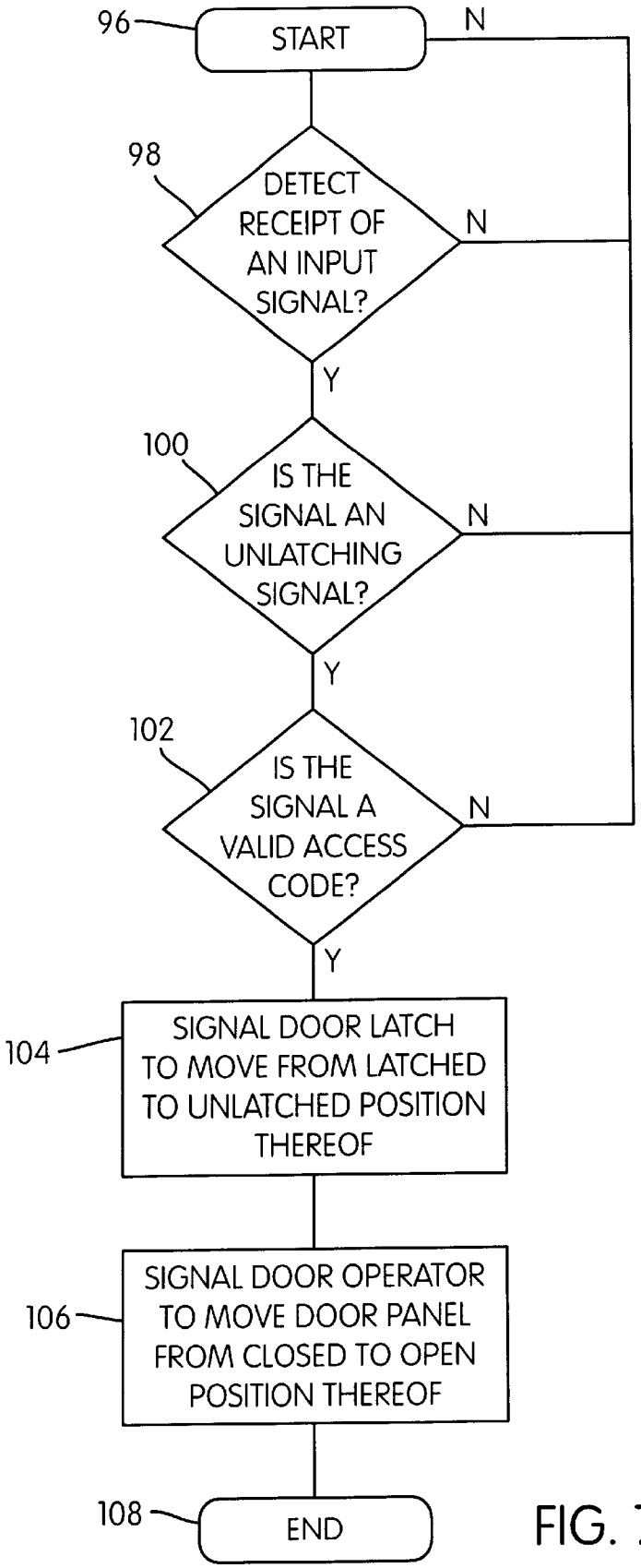
FIG. 7 is a flowchart illustrating the manner in which the controlling system operates to perform an unlatching and opening sequence responsive to the input device receiving an unlatching signal containing a valid access code when the door panel is closed and the door latch is in the latched position thereof.

FIG. 7 is a flow chart showing how the controlling system performs a simultaneous unlatching and opening sequence. At the start of the operation (block 96), the door panel 14 is in the fully closed position thereof and the door latch 30 is in the latched position to maintain the door panel 14 in its closed position. The controlling system (whether it is the input device 80 or the controller 48) detects for an input signal (block 98) in a passive manner.

If no input signal is detected, the controlling system simply awaits for receipt of one. When an input signal has been received, the controlling system determines whether the signal is an unlatching signal (block 100). If the signal is not an unlatching signal, then the controlling system continues to passively await receipt of an unlatching input signal. This is because any signals other than an unlatching signal are useless while the door latch 30 is in the latched position thereof and could possibly cause component damage if the operator 46 is activated while the door latch 30 is latched.

Once the controlling system has determined that the input signal is an unlatching signal, it then determines whether the signal contains, carries, or is encoded with a valid access code (block 104). If the answer is no, then the system awaits receipt of an unlatching signal that has a valid access code. If the answer is yes, then the controlling system, in particular the controller 48, signals or otherwise causes the door latch 30 to move to the unlatched position thereof (block 104). Then, the controller 48 signals or otherwise causes the door operator 46 to begin moving the door panel 14 in its opening direction (block 106). Once the sequence has ended (block 108) with the door latch 30 in the unlatched position, the door panel 14 may be opened or closed either under power by transmitting door opening and closing signals (which are separate from the unlatching input signal) to the input device 80 or manually by applying manual pushing or pulling force to the door panel. It is not important at this point in the illustrated processing scheme to make a determination whether the subsequent input signals carry a valid access code because the door panel 14 can be manually opened or closed anyway as a result of the latch 30 being in the unlatched position thereof.

It should be noted that the present invention contemplates incorporating some or all of the additional security features disclosed in the above-incorporated '585 patent, into the functions of the controlling system.

For simplicity's sake, blocks 98, 100, and 102 of the sequence of FIG. 7 may be collapsed into one determination. That is, the controlling system may simply determine whether an unlatching input signal carrying a valid access code has been received instead of making three separate determinations.

When a manual keypad is being used, punching or keying in the predetermined valid access code also will serve as input of an unlatching signal. Stated differently, the controlling system will function to unlatch the door latch 30 and open the door panel 14 in response to the predetermined numeric access code. Likewise, insertion of a passcard or the like also will constitute input of an unlatching signal with a valid access code.

A manual control pad 110 is secured to the frame 12 on the interior side thereof that comprises a part of the input device 80. The control pad 110 has buttons for latching and unlatching the door latch 30 and buttons for opening and closing the door panel 14 via door operator 46 operation. Operation of the control pad 110 does not require use of a valid access code because it is assumed a person located inside the residential structure is authorized to operate the controlling system. The control pad 110 may also include buttons for activating and deactivating various security features from the aforementioned '585 patent.

Figure 8:
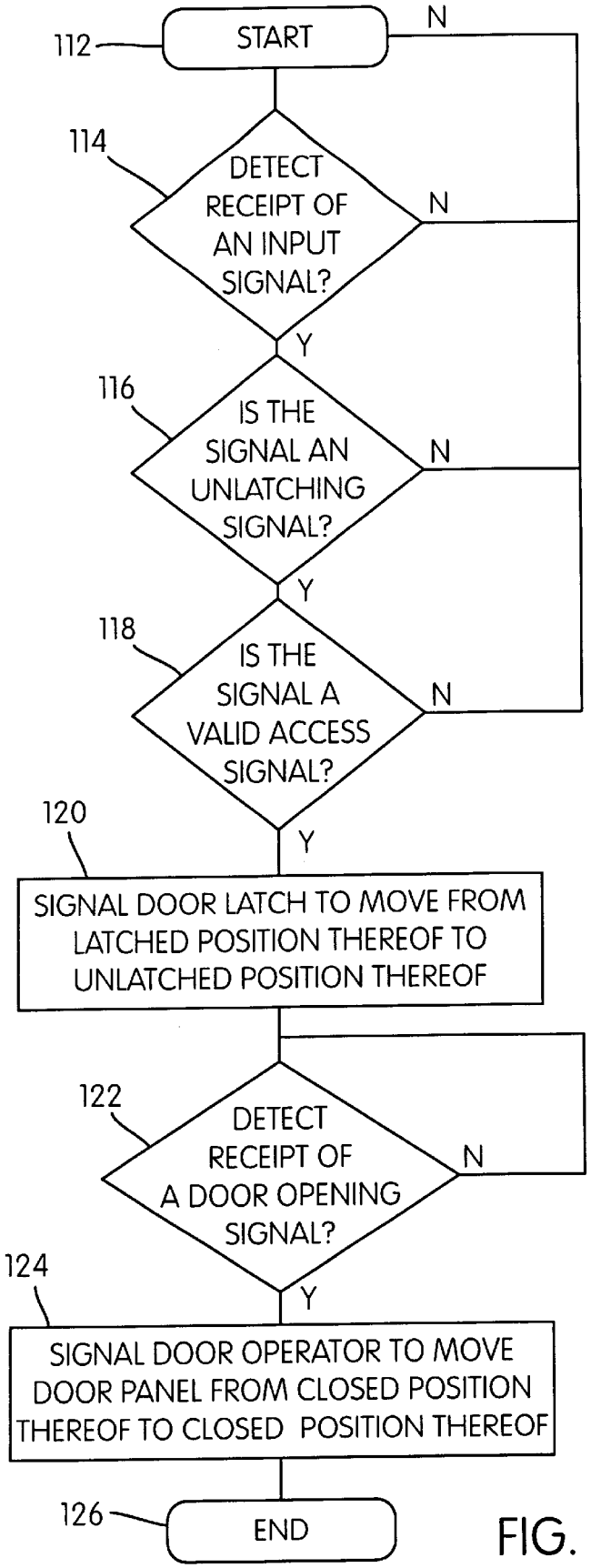
FIG. 8 is a flowchart illustrating an alternative manner in which the controlling system operates to perform an unlatching sequence upon receiving an unlatching signal containing a valid access code and then a subsequent opening sequence upon receiving a subsequent door opening signal when the door panel is closed and the door latch is in the latched position thereof.

FIG. 8 shows an alternative unlatching and opening sequence for the controlling system. Blocks 112, 114, 116, 118, and 120 correspond to blocks 96, 98, 100, 102, and 104, respectively, of FIG. 7. After moving the door latch 30 to the unlatched position thereof (block 120), the controlling system then detects for transmission of a door opening signal (block 122). When a door opening signal is received, then the controller 48 signals or otherwise causes the door operator 46 to move the door panel 14 under power in its door opening direction (block 124). Once the sequence has ended (block 126), the door panel 14 may be opened or closed either under power by transmitting door opening and closing signals to the input device 80 or under by manual power by applying manual pushing or pulling force to the door panel.

In an alternative processing scheme, the unlatching and door opening operation may be initiated by the input device receiving a single valid access signal instead of an initial unlatching signal and then a subsequent door opening signal.

It can thus be understood that the objectives of the present invention have been achieved by the foregoing preferred embodiment. It is to be understood, however, that the foregoing preferred specific embodiment has been provided solely to illustrate the structural and functional principles of the present invention and is not intended to be limiting. To the contrary, the principles of the present invention are intended to encompass all modifications, alterations, and substitutions within the spirit and scope of the appended claims.

It should be noted that the appended claims do not have limitations phrased in the "means or step for performing a specified function" format permitted by 35 U.S.C. §112, paragraph 6. This is to make clear that the appended claims are not intended to be interpreted under §112, paragraph 6 as being limited solely to the structure, material, or acts described in the present application and their equivalents.

What is claimed:

1. A pre-hung door assembly for installation across an opening through a wall of a building, said door assembly comprising:

a frame constracted and arranged to be mounted along a peripheral edge of the wall opening when said door assembly is installed, said frame providing a doorway through which persons can travel;

a door panel pre-hung mounted to said frame prior to installation of said pre-hung door assembly, said door panel being movable between (a) an open position wherein said door panel is moved away from said doorway to permit persons to travel therethrough and (b) a closed position wherein said door panel is moved into covering relation with respect to said doorway to prevent persons from traveling therethrough;

a power-operated door latch pre-mounted to one of said door panel and said frame prior to installation of said door assembly, said door latch being operable under power to selectively move between (a) a latched position wherein, when said door panel is in the closed position thereof, said door latch engages structure on the other of said door panel and said frame to releasably maintain said door panel in the closed position thereof, and (b) an unlatched position wherein said door latch allows said door panel to move from said closed position thereof to said open position thereof;

a power-operated door operator pre-mounted between said door panel and said door frame prior to installation of said door assembly, said door operator being operable under power to selectively move said door panel relative to said frame between said open and closed positions thereof; and a controlling system communicated to said door latch and said door operator prior to installation of said door assembly and having an input device adapted to receive an input signal, said controlling system being adapted to control said door operator so as to cause said door operator to move said door panel from said closed position thereof to said open position thereof responsive to said input device receiving an input signal, said controlling system also being adapted to control said door latch so as to cause said door latch to move from said unlatched position thereof to said latched position thereof responsive to said input device receiving input signal;

wherein said door panel being pre-hung to said frame, said latch being pre-mounted to said one of said door panel and said frame, said door operator being pre-mounted between said door panel and said door frame, and said controlling system being pre-installed in communication with said door latch and said door operator enables said pre-hung door assembly to be installed as a unit across the opening of the wall by mounting the frame to the peripheral edge of the opening.

2. A pre-hung door assembly according to claim 1, wherein said controlling system being adapted such that, at least when said door panel is in said closed position thereof with said door latch in said latched position thereof and an input signal is supplied to said input device, said controlling system determines whether said input signal is a valid access signal and then operates said door latch so as to cause said door latch to move from said latched position thereof to said unlatched position thereof only if said input signal is determined to be a valid access signal.

3. A pre-hung door assembly according to claim 2, wherein said controlling system is adapted such that, at least when said door panel is in said closed position thereof with said door latch in said latched position thereof and the input signal is supplied to said input device, said controlling system determines whether said input signal is a valid access signal and then, only if said input signal is determined to be a valid access signal, operates both said door latch so as to cause said door latch to move from said latched position thereof to said unlatched position thereof and said door operator so as to cause said door operator to move said door panel from said closed position thereof towards and into said open position thereof.

4. A pre-hung door assembly according to claim 2, wherein said controlling system is adapted such that, at least when said door panel is in said closed position thereof with said door latch in said latched position thereof and the input signal supplied to said input device is a door unlatching signal, said controlling system determines whether said unlatching input signal is a valid access signal and then operates only said door latch so as to cause said door latch to move from said latched position thereof to said unlatched position thereof only if said controlling system determines that said unlatching input signal is a valid access signal;

said controlling system being adapted to operate said door operator to move said door panel from said closed position thereof towards and into said open position thereof when the input signal supplied to said input device is a door opening signal separate from the unlatching input signal.

5. A pre-hung assembled door assembly according to claim 1, wherein said door panel is pre-hung by being pivotally connected to said frame for pivotal movements about a generally vertical pivot axis between the open and closed positions thereof.

6. A pre-hung door assembly according to claim 5, wherein said door operator is pre-mounted to said frame and has an output shaft extending generally parallel to the generally vertical pivot axis of said door panel, said door operator further comprising a radial arm having a first end thereof pre-connected to said output shaft for rotation therewith and a second end thereof carrying a rotatable roller, said door panel providing an elongated track in which the roller on said radial arm is received, said door operator moving said door panel between said open and closed positions thereof by rotating said output shaft under power so as to rotate said radial arm and roll said roller within said track such that said roller and said track cooperate to affect pivotal movement of said door panel.

7. A pre-hung door assembly according to claim 1, wherein said power-operated door latch is pre-mounted to said frame.

8. A pre-hung door assembly according to claim 7, wherein said power-operated door latch is pre-mounted along a vertically extending edge of said frame.

9. A pre-hung door assembly according to claim 1, wherein said input device comprises a receiver pre-mounted on said frame prior to installation of said door assembly and a remote transmitter that is carried by a person and selectively operated to transmit input signals to said receiver.

10. A pre-hung door assembly according to claim 1, wherein said input device is a keypad pre-mounted on an exterior side of said door assembly prior to installation of said door assembly into which a person desiring entrance into the building manually keys the aforesaid input signals.

11. A pre-hung door assembly according to claim 1, wherein said input device comprises an electronic card reader and a card carried by a person actuates said card reader to generate the input signal.

12. A pre-hung door assembly according to claim 1, wherein said frame comprises a pair of vertically extending door jambs and a upper frame member extending perpendicularly between upper ends of said door jambs.

13. A pre-hung door assembly according to claim 1, wherein said power-operated door latch is pre-mounted to said door panel.

14. A pre-hung door assembly according to claim 1, wherein said door operator and said latch are electrically powered and wherein said door assembly further comprises a battery for supplying electricity to said operator and said latch.

15. A pre-hung door assembly according to claim 1, wherein said frame assembly has guide rails and wherein said door panel is a sliding door panel pre-mounted to said guide rails for guided, rectilinear movement between the open and closed positions thereof.

16. A pre-hung door assembly according to claim 1, wherein said operator is pre-mounted to said frame such that, when said assembly is installed in the opening of a wall having a pair of spaced apart exterior wall members, said operator is received between the spaced apart wall members.

17. A pre-hung door assembly according to claim 1, wherein said operator is pre-mounted within an interior of said door panel.

18. A pre-hung door assembly for installation across an opening through a wall of a building, said door assembly comprising:

a frame constructed and arranged to be mounted along a peripheral edge of the wall opening when said door assembly is installed, said frame providing a doorway through which persons can travel;

a door panel pre-hung to said frame prior to installation of said pre-hung door assembly, said door panel being movable between (a) an open position wherein said door panel is moved away from said doorway to permit persons to travel therethrough and (b) a closed position wherein said door panel is moved into covering relation with respect to said doorway to prevent persons from traveling therethrough;

a power-operated door operator pre-mounted between said door panel and said door frame prior to installation of said door assembly, said door operator being operable under power to selectively move said door panel relative to said frame between said open and closed positions thereof; and a controlling system pre-installed in communication with said door operator prior to installation of said door assembly, and having an input device adapted to receive an input signal, said controlling system being adapted to control said door operator so as to cause said door operator to move said door panel from said closed position thereof to said open position thereof responsive to said input device receiving an input signal;

wherein said door panel being pre-hung to said frame, said door operator being pre-mounted between said door panel and said door frame, and said controlling system being pre-installed in communication with said door operator enables said pre-hung door assembly to be installed as a unit across the opening of the wail by mounting the frame to the peripheral edge of the opening.

19. A pre-hung door assembly according to claim 18, wherein said door panel is pre-hung by being pivotally connected to said frame for pivotal movements about a generally vertical pivot axis between the open and closed positions thereof.

20. A pre-hung door assembly according to claim 19, wherein said door operator is pre-mounted to said frame and has an output shaft extending generally parallel to the generally vertical pivot axis of said door panel, said door operator further comprising a radial arm having a first end thereof pre-connected to said output shaft for rotation therewith and a second end thereof carrying a rotatable roller, said door panel providing an elongated track in which the roller on said radial arm is received, said door operator moving said door panel between said open and closed positions thereof by rotating said output shaft under power so as to rotate said radial arm and roll said roller within said track such that said roller and said track cooperate to affect pivotal movement of said door panel.

21. A prehung door assembly according to claim 18, wherein said input device comprises a receiver pre-mounted on said frame prior to installation of said door assembly and a remote transmitter that is carried by a person and selectively operated to transmit input signals to said receiver.

22. A pre-hung door assembly according to claim 18, wherein said input device is a keypad fixed on an exterior side of said door assembly prior to installation of said door assembly into which a person desiring entrance into the building manually keys the aforesaid input signals.

23. A pre-hung door assembly according to claim 18, wherein said input device comprises an electronic card reader and a card carried by a person actuates said card reader to generate the input signal.

24. A pre-hung door assembly according to claim 18, wherein said frame comprises a pair of vertically extending door jambs and a upper frame member extending perpendicularly between upper ends of said door jambs.

25. A pre-hung door assembly according to claim 18, wherein said door operator is electrically powered and wherein said assembly further comprises a battery for supplying electricity to said operator.

26. A pre-hung door assembly according to claim 18, wherein said frame assembly has guide rails and wherein said door panel is a sliding door panel pre-mounted said guide rails for guided, rectilinear movement between the open and closed positions thereof.

27. A pre-hung door assembly according to claim 18, wherein said operator is pre-mounted to said frame such that, when said assembly is installed in the opening of a wall having a pair of spaced apart exterior wall members, said operator is received between the spaced apart wall members.

28. A pre-hung door assembly according to claim 18, wherein said operator is mounted within an interior of said door panel.

* * * * *